US005318787A

United States Patent [19]

Brauner et al.

[11] Patent Number: 5,318,787

[45] Date of Patent: Jun. 7, 1994

[54] CEREAL SAMPLER PACKAGE

[75] Inventors: Arne H. Brauner, Minnetonka; Bradly A. Faber, Falcon Heights; Steven C. Robie, New Hope, all of Minn.

[73] Assignee: General Mills, Inc., Minneapolis, Minn.

[21] Appl. No.: 992,343

[22] Filed: Dec. 17, 1992

Related U.S. Application Data

[63] Continuation of Ser. No. 951, Jan. 5, 1987, Pat. No. Des. 304,385.

[51] Int. Cl.[5] ..... B65D 6/00; B65D 21/02

[52] U.S. Cl. ..... 426/120; 206/216; 215/6; 215/10; 215/100 R; 220/23.4; 220/23.6; 220/23.86; 426/110; 426/115

[58] Field of Search ..... 426/108, 110, 115, 119, 426/120; 215/100 R, 6, 10; 220/556, 505, 502, 527, 528, 23.83, 23.86, 23.4, 23.6; 206/216

[56] References Cited

U.S. PATENT DOCUMENTS

| | | | |
|---|---|---|---|
| 3,413,128 | 11/1968 | Steinbarth | 426/115 |
| 3,797,658 | 3/1974 | Peacock | 206/216 |
| 4,635,291 | 1/1987 | Barton | 215/100 R |
| 5,050,757 | 9/1991 | Hidding et al. | 220/23.4 |
| 5,123,460 | 6/1992 | Reed | 220/23.4 |

FOREIGN PATENT DOCUMENTS

| | | | |
|---|---|---|---|
| 470269 | 12/1950 | Canada | 215/100 R |

*Primary Examiner*—Michael W. Ball
*Assistant Examiner*—R. Robey
*Attorney, Agent, or Firm*—John A. O'Toole; L. MeRoy Lillehaugen

[57] ABSTRACT

A thermoformed bowl filled and sealed with a sample food product forms a sample package. The bowl is sized and shaped to the contours of and so as to nest upon the shoulders of a plastic one gallon jug or bottle. The package has a centrally located die-cut hole to lock under the bottle neck boss. Free samples of the food product can thus be distributed to accompany regular sales of one gallon plastic containers of milk.

12 Claims, 4 Drawing Sheets

CEREAL SAMPLER PACKAGE

CROSS REFERENCE TO RELATED APPLICATION

This application is a continuation of commonly assigned Design application U.S. Ser. No. 000,951, filed Jan. 5, 1987 entitled FOOD PACKAGE now Design Pat. No. 304,385.

FIELD OF THE INVENTION

The present invention relates to food packaging. More particularly, the present invention relates to sample containers adapted to nest upon the neck and shoulders of one gallon milk containers.

BACKGROUND OF THE INVENTION

Ready-To-Eat ("R-T-E") cereal manufacturers engage in wide varieties of activities designed to promote new, improved, or existing R-T-E cereal products. One common technique is to distribute a coupon redeemable at a food retailer in connection with the purchase of the manufacturer's product. Another technique is to increase the advertising of the product. While such promotion activities are helpful in promoting the sale of the manufacturer's product, consumers are even more inclined to purchase a product after the consumer has had an opportunity to actually sample the product.

A variety of techniques are used to provide actual samples of the food product to consumers for testing. One technique is to hand out samples of the product in retail stores where the product is typically purchased. Another technique is to mail free samples of the product to consumers. A third technique is to include inserts of the sample product in other products sold to the consumer. While these several techniques are useful and indeed are popular, there is a continuing need for new, useful and innovative techniques for distributing samples of food products to consumers to facilitate the consumers sample use of such food products.

In particular, it would be especially useful to tie the provision of a sample of a food product to be promoted with the purchase of a product typically used in connection with the food product being promoted. Thus, for example, for R-T-E cereal manufacturers, it would be desirable to tie a sample of an R-T-E cereal with the purchase of a container of milk since milk is typically used in association with the consumption of R-T-E cereals.

However, a number of problems are presented by such proposed association. For example, in the fabrication and use of conventional milk containers, such container designs are well established as are the systems for filling and distributing such packaged food items. Any design for a sample container must accommodate such designs and distribution systems. Such sample package designs must also accommodate the intermediate storage systems for such packages. In particular, for milk containers, such sample designs must not interfere with the conventional method of handling milk containers that involve the insertion of the packages into milk cases, especially the stackability of such cases.

Still another problem resides in the provision of a sampler package containing a sufficient amount of volume to hold about one oz. of sample R-T-E cereal having densities as low as 0.1 g/cc. Useful sample packages must have a product reservoir large enough to hold useful quantities of the cereal yet nonetheless not adversely affect the routine handling of the filled bottles.

Still another problem resides in fabricating articles suitable for ordinary usage by consumers. Frequently, the consumer will grip the combined article by the sample package to lift the article. If the sample package is inadequately secured to the bottle, the sample can become untimely separated from the bottle and the bottle may fall. On the other hand, the sample must be relatively easy to remove from the bottle when such removal is timely. The feature which removably secures the sample to the bottle thus must be strong yet removable and, of course, inexpensive.

Accordingly, it is an object of the present invention to provide a food product sample package of a new and useful design.

It is a further object of the present invention to provide new and useful food product package designs that are adapted to be removably secured to supporting packages.

Still another object of the present invention is to provide improved sample package designs that are useful in connection with conventional plastic containers for fluid foods such as milk, juice and water.

Still another object of the present invention is to provide carton designs that can be used in connection with supporting fluid containers that minimize handling problems in the conventional distribution and sale of such fluid products.

Still another object of the present invention is to provide a sample package that is resistant to dislocation from the supporting food package yet nonetheless can, when desired, be conveniently detached from the bottle.

Another object of the present invention is to provide a sample product package having removable engagement means that is simple and inexpensive to fabricate and assemble.

These and other objects of the present invention are described in the description of the preferred embodiments below.

The present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where.

Figure 1:
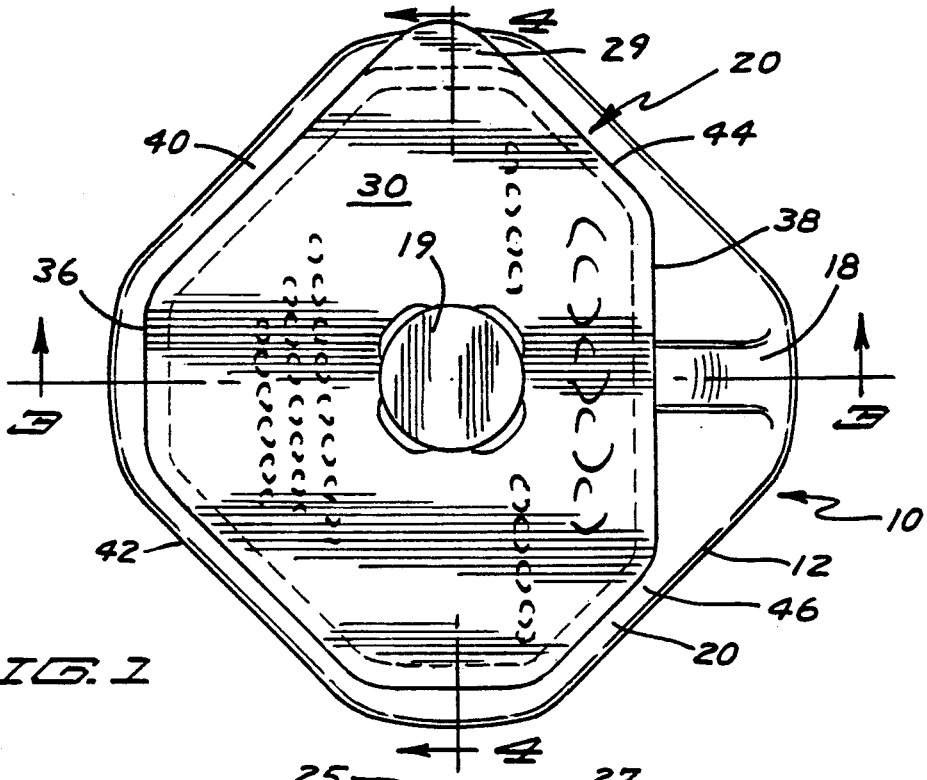
FIG. 1 is a top plan view of the food product sampler package of the present invention nested upon the upper portion of a one gallon plastic container for fluids.

The figure is drawn for ease of explanation of the basic teachings of the present invention only; the extensions of the figure with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the drawings, the same numerals designate the same or similar parts. Furthermore, when the terms "top," "bottom," "first," "second," "side," "edge," and similar terms are used herein, it should be understood that these terms have reference only to the structure shown in the drawings as it would appear to a person viewing the drawings and are utilized only to facilitate describing the invention.

DESCRIPTION OF THE PREFERRED EMBODIMENTS

Figure 2:
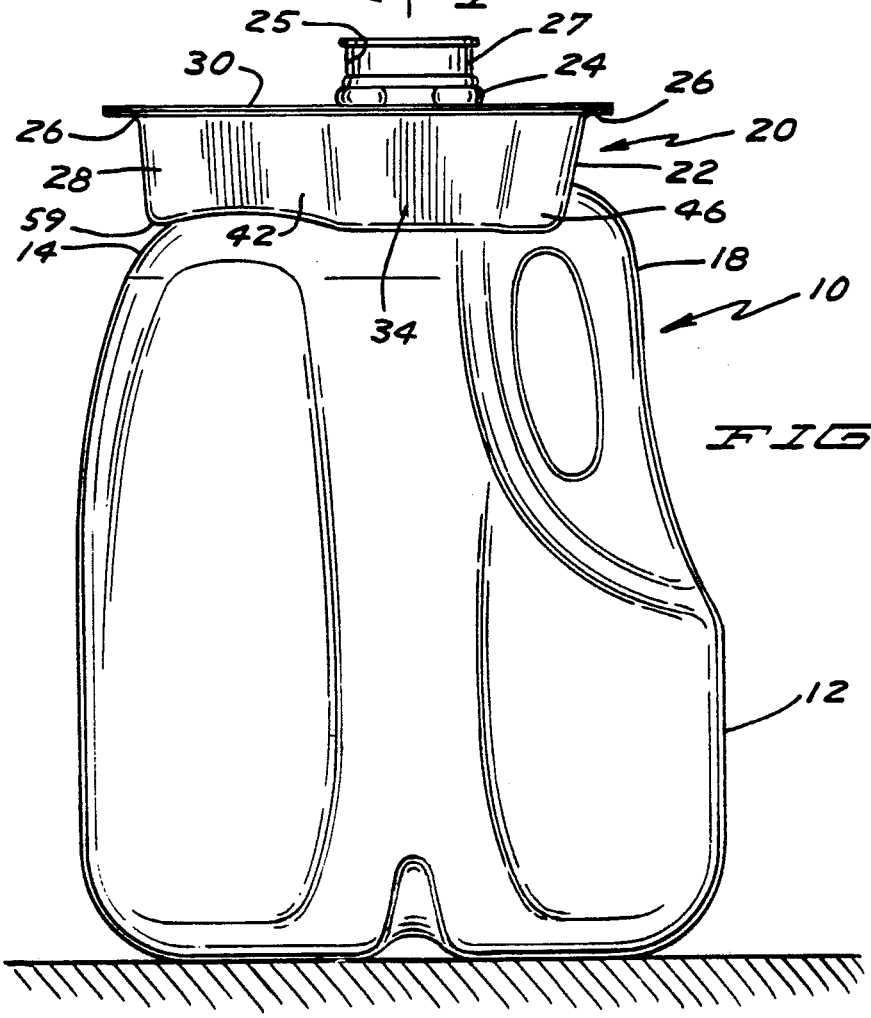
FIG. 2 is a side elevational view of the food product sampler package shown nesting upon the shoulders of a one gallon plastic container for fluids.

Referring now to the drawings and in particular to FIGS. 1 and 2, there is shown an embodiment of the present food article designated generally by reference numeral 10. In FIG. 2, it is seen that the present article 10 comprises a conventional one gallon blow molded plastic milk jug or container 12 having a plurality of jug shoulders 14, a neck 16 and a vertically aligned handle 18 whose upper end is positioned proximate the shoulders 14. The article 10 additionally essentially comprises a novel food product sample package or container 20 that is adapted to conform to and nest upon the jug shoulders 14. The sampler package 20 is removably secured to the jug 12 by engaging the bottle neck 16 as described in greater detail below. The sample package 20 essentially comprises a particularly configured bowl or tray 22 having a contoured bottom shape that allows the container 20 to nest upon the shoulders 14, neck 16 and handle portion 18 of the jug 12 without rotational movement.

Still referring to FIG. 2, it can be seen that the jug 12 is of conventional shape, design and materials and is fabricated according to well known blow molding techniques. Generally, jugs 12 can be fabricated of high density polyethylene such as by blow molding. The neck 16 additionally includes an orifice 25 sealed with a removable cap 27.

In particular, the jug neck 16 is conventionally fabricated with an annular ring or circumferential protuberance 24 sometimes also referred to in the art as a neck "boss." The boss feature is sometimes used for gripping or lifting or otherwise handling the bottle during fabrication, filling and processing. While a particular boss design may have a continuous ring shape, other bottles use other boss designs. For example, in the conventional embodiments shown, the boss will be discontinuous or segmented, e.g., having a plurality (e.g., four) of arcuate portions evenly distributed about the circumference of the bottle neck and spaced with blank or unraised portions.

While the present description is particularly directed to blow molded plastic jugs for fresh fluid milk, the skilled artisan will appreciate that such jugs and the present sample package can be used in connection with other packages for products in fluid form, e.g., fruit juices, water, or even non-food product packages, e.g., such as for cleaning solutions or bleach.

Referring still to FIG. 2 it can be seen that the bowl 22 includes a generally vertically oriented depending continuous vertical sidewall 28 and a first outer laterally extending peripheral flange 26 that generally corresponds in shape to the shape of the sidewall 28.

Referring now back briefly to FIG. 1, it can be seen that the container 20 further includes a removable sealing layer 30 overlaying and sealing the container 20 adhesively secured to the flange 26. Sealing layer 30 can include conventional graphics and/or script information and removal tab 31.

In FIG. 1 it can be further seen that in the preferred embodiment the continuous sidewall 28 and correspondingly shaped first flange 26 generally forms an irregular or truncated polygon and in the embodiment depicted comprises eight sidewall portions. In more preferred embodiments, the present polygon shape comprises a symmetrical plurality of straight portions (from a square) spaced between a plurality of concentric spaced arcuate portions (from a circle). The sidewall includes first, second and third spaced arcuate portions and two intermediate portions. The sidewall further includes a third linear portion spaced opposite to a middle arcuate wall portion, and an opposed pair of minor linear portions intermediate the third linear portion and the first and third arcuate portions. However, as described in further detail below, that portion intended to overlay the handle is cut-off or truncated. Specifically, the sidewall 28 comprises an opposed pair of spaced parallel, aligned and equal length arcuate sidewall portions 32 and 34 and a pair of parallel aligned, spaced, unequal wall portions 36 and 38. The container sidewall 28 further comprises a pair of larger angled wall portions 40 and 42 connecting wall portions 34 and 32 with wall section 36. Finally, sidewall 28 additionally comprises a pair of smaller angled wall portions and connecting wall portions 32 and 34 with wall portion 38.

It is not important that the shape of the edges of outer flange 26 correspond exactly to the shape of the outer sidewall 28. Thus, the flange edge may be straight or arcuate regardless of the shape of the corresponding sidewall portion. The corners can be sharp or preferably rounded.

In FIG. 1 it can be further seen that the container 20 additionally comprises a center hole or aperture disposed through which is the jug neck 16.

The bottom dish or bowl 22 is comprised of a semi-rigid thermally molded plastic member such as high density polyethylene fabricated by a thermoforming technique or other suitable plastic container material and technique. In preferred embodiments, the bowl or tray 22 is clear or at least semi-transparent so that the contained sample foodstuff is visibly apparent.

Figure 3:
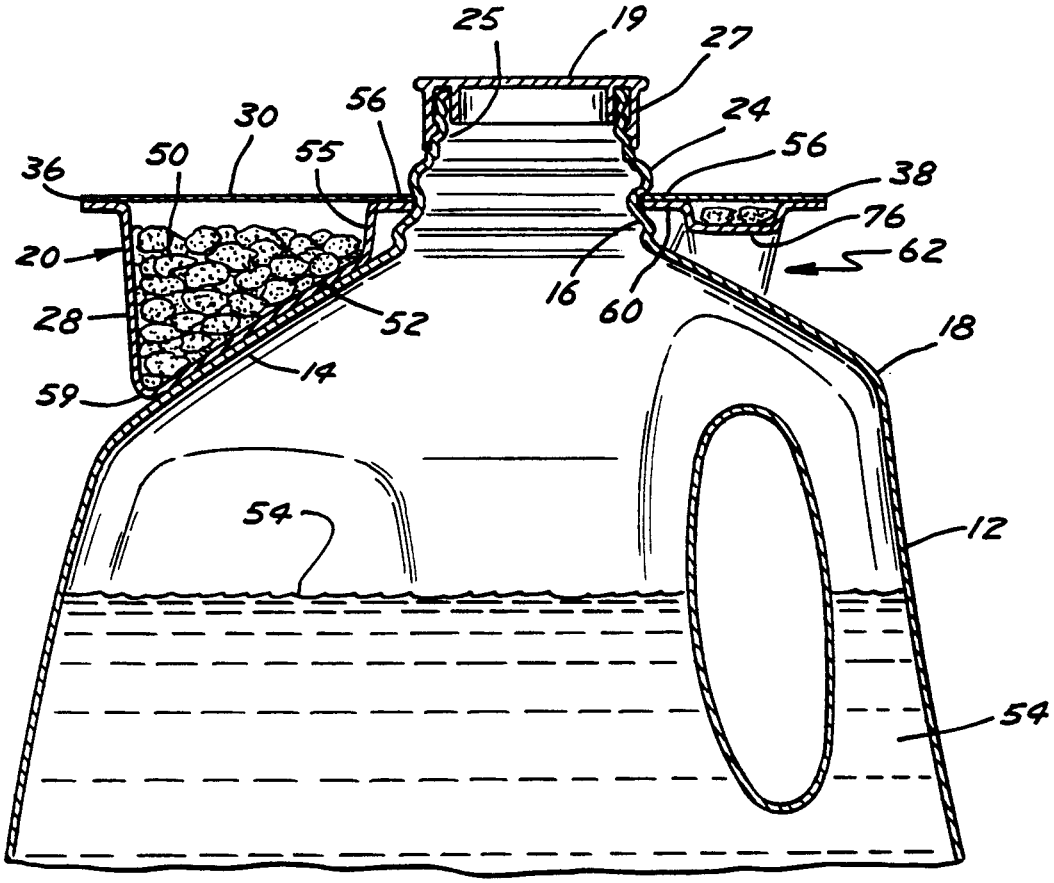
FIG. 3 is an enlarged, partially broken away, sectional view of the package taken along lines 3—3 of FIG. 1.
Figure 4:
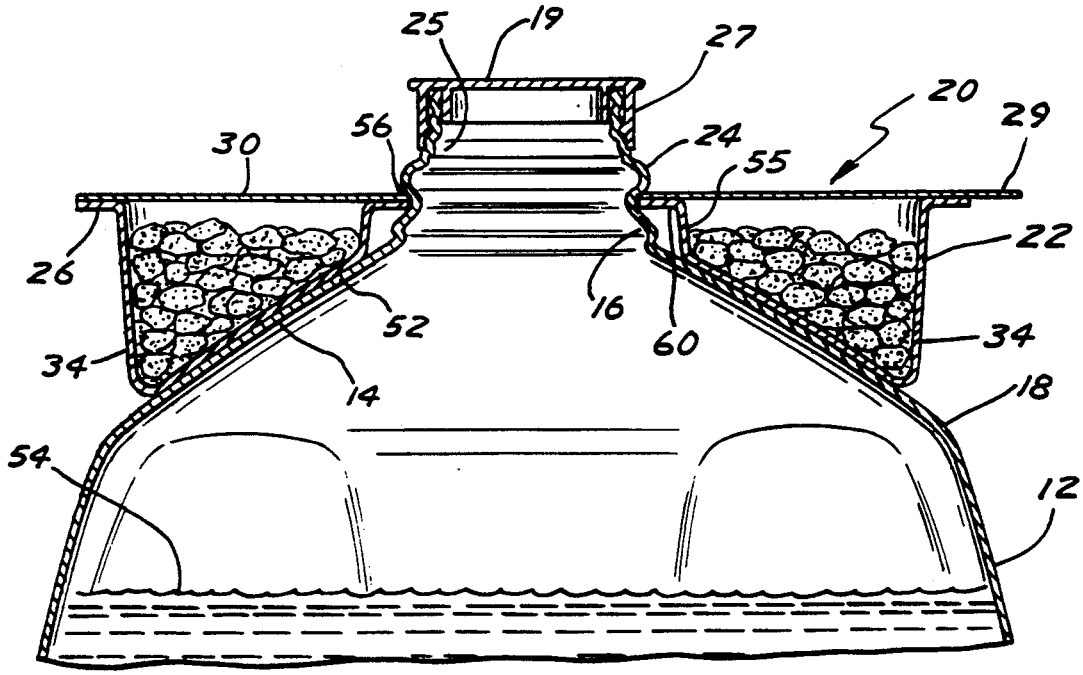
FIG. 4 is an enlarged, partially broken away, sectional view taken along lines 4—4 of FIG. 1.

Referring now to FIG. 3 there is shown that the container 20 additionally comprises a quantity of sample material 50 such as a foodstuff or liquid or powdered cleaning material disposed and sealed within the container 20. In FIG. 3 it can be further seen that the jug 12 contains a suitable liquid or fluid 54 disposed therein such as milk, (e.g., whole milk, skim milk, low-fat milk, whether regular or flavored) or fruit juice, water, or other beverage or liquid. In preferred embodiments, the contained fluid 54 is milk and the sample food product 50 is a food product typically consumed with milk, especially an R-T-E cereal. Of course, the sampled food product 50 could be other such food items as cookies, powdered milk flavorings (e.g., chocolate), or any other suitable foodstuff, e.g., dried tea or coffee solids. Conveniently, the tray can hold about one oz of R-T-E cereal having a density as low as 0.1 g/cc, i.e., has a volume of up to 300 cc.

In FIG. 3 it can be further seen that the container 20 additionally comprises a contoured bottom 52, (e.g., curved) adapted to conform in confronting relationship with the shape of the jug shoulders 14 such as the frustoconical shape depicted. FIG. 3 also shows that the container 20 additionally comprises a second, inner annular minor vertically aligned sidewall 55 which at one end descends from a second circumferential inwardly extending peripheral flange 56 defining the interior hole or aperture 48. At its other end, inner sidewall 55 joins the bottom wall 52. The container 20 is fabricated with and additionally comprises means 60 for removably and securely engaging the neck boss 24 so as to secure the container 20 to the milk jug 12. In the simplest and most convenient embodiment, such engagement means can comprise fabricating the aperture 48 to have a diameter slightly less than the diameter of the neck boss 24. In operation, the flexible flange 56 snaps under the neck boss 24 as the package 20 is mounted upon the milk jug 12. In other embodiments, (not shown) the engagement means can comprise fabricating the container to have a gripping ring bonded to the inner circular flange 56 or a ring with inwardly projecting flexible teeth.

In FIG. 3 it can be further seen that the bowl 22 includes a means for preventing rotational movement around the neck 16 such as providing the bowl 22 with a notch 62 feature that also assists in the mounting of the container 20 to the jug 12. The notch 62 is in the continuous sidewall 28 and more particularly in the truncated portion 38. The particular design of notch 62, will vary depending upon the position, size, and shape of the handle 18.

Figure 5:
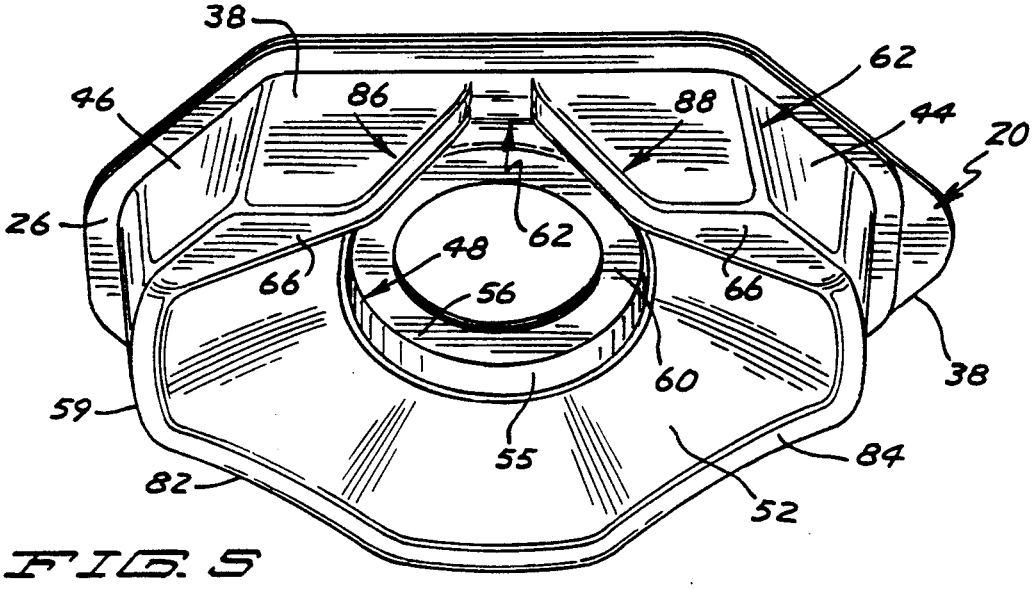
FIG. 5 is a perspective view of the bottom of the package.

FIG. 5 further illustrates that bowl 22 can have a continuous rounded and generally circular bottom edge or rim 59. The bottom edge 59 is a spline or intersection defined by the intersection of the bottom wall 52 and the outer sidewall 28. In highly preferred embodiments, bottom edge 59 can have first and second arcuate or scalloped portions 82 and 84. The bottom edge 59 terminates at one end at a first planar horizontal surface 64 and at its other end at a second spaced mirror image horizontal surface 68 on either side of the inverted V-notch 62.

Figure 6:
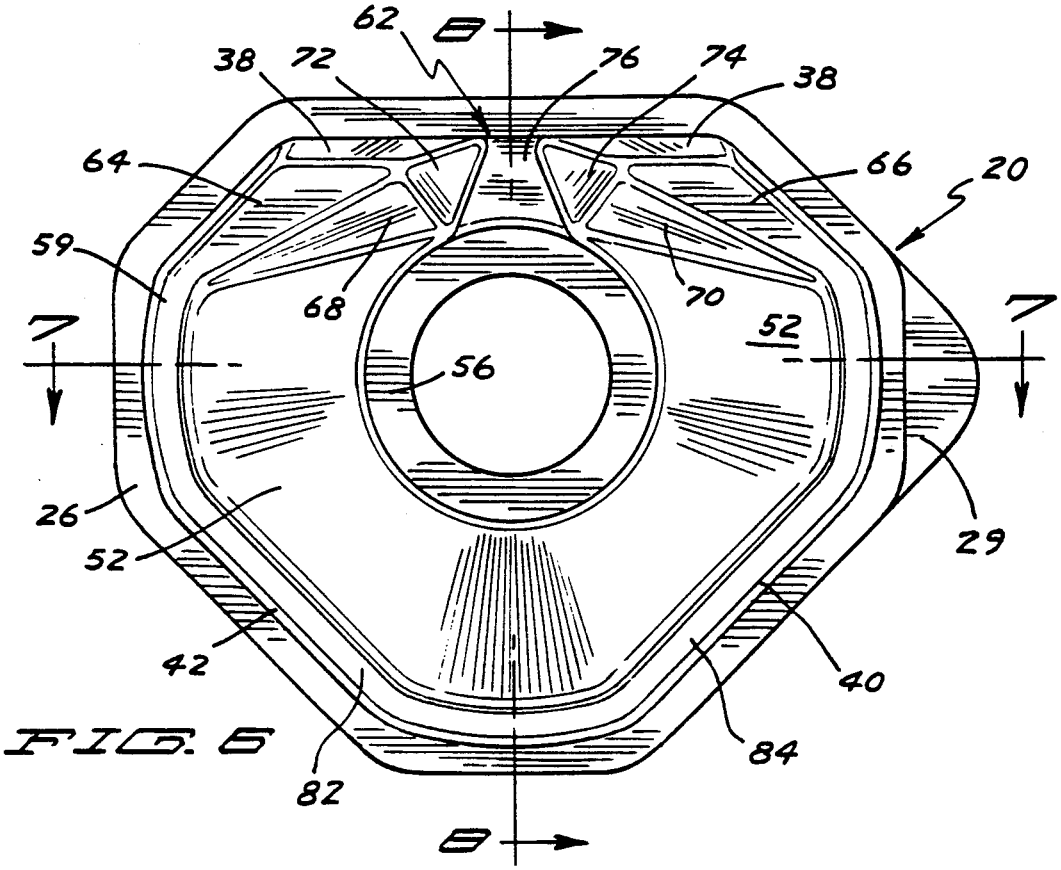
FIG. 6 is a bottom plan view of the food product sampler package.

Reference is now made to FIGS. 5 and 6 which illustrate the V-notch 62 in greater detail. In particular, it can be seen in FIGS. 5 and 6 that the notch 62 is fabricated in sidewall portion 38. The notch 62 generally is an inverted shallow bottom V-shaped type notch having a shallow width 80 slightly longer than the width of the bottle handle 18 (not shown).

In FIG. 6, it can be seen that, in the particular embodiment depicted, notch 62 further includes a pair of spaced, symmetric, portions 69 and 70 of curved bottom wall 52. Additionally, the notch 62 includes a pair of spaced, symmetric wall portions 72 and 74. Finally, the notch includes a generally horizontally extending minor bottom wall or bridge portion 76.

The skilled artisan will readily appreciate that the various constituent element portions of the bowl 22 are seamlessly continuous as is conventional in plastic tray manufacture. The skilled artisan can also fabricate notch designs of other particular configurations which allow the bowl to nest upon the bottle without departing from the spirit of the present invention.

Figure 7:
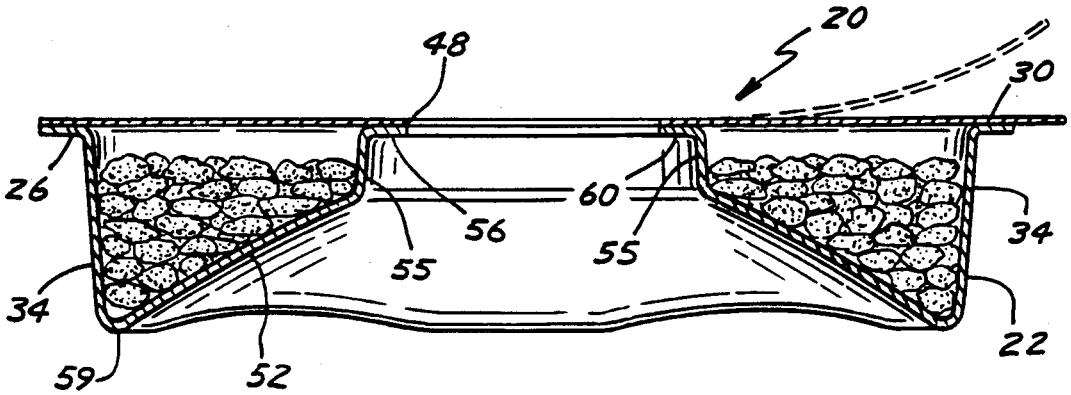
FIG. 7 is a partially cut away sectional view of the cereal sampler package with the closure partially open taken along lines 7—7 of FIG. 6.

Reference is now made briefly to FIG. 7 which shows that the sealing layer 30 is removably secured to flange 26 in conventional manner. The sealing layer extends over the open end of the bowl and is removably sealed at its outer edge against the upper surface of the first outer flange and at an inner edge against the second inner flange. As the sealing layer 30 is removed (and shown in relief in a partially open position) the sealing layer 38 acts as a removable closure for the food contents 50 of the container 20. If desired, the sealing layer can be constructed with an opening tab (not shown) to facilitate removal.

Figure 8:
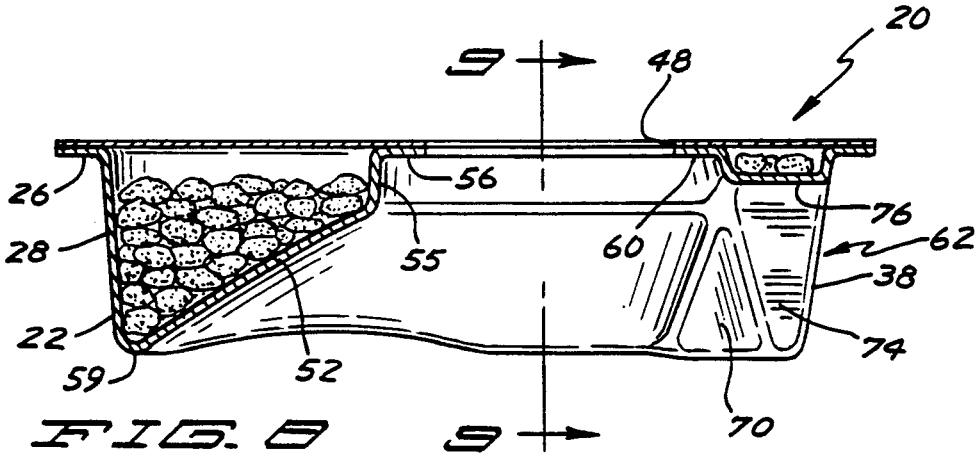
FIG. 8 is a sectional view, partially cut away, taken along lines 8—8 of FIG. 6.
Figure 9:
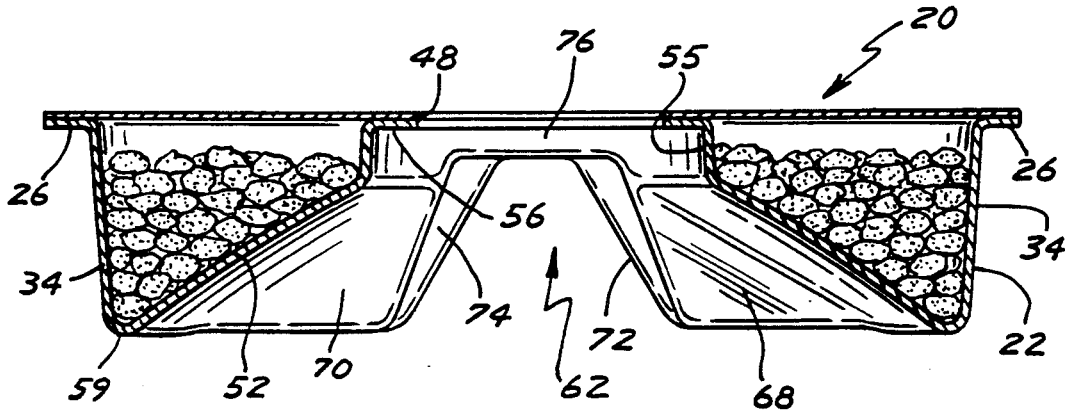
FIG. 9 is a sectional view taken along lines 9—9 of FIG. 8.

Reference is now made briefly to FIGS. 8 and 9 which further illustrate the shape and configuration of the bowl 22.

Thus, since the invention disclosed herein may be embodied in and other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalence of the claims are intended to be embraced therein.

What is claimed is:

1. A composite food package article, comprising:

a bottle having a body, a neck at an upper end, a plurality of shoulders proximate the neck, a vertically aligned handle terminating at its upper end proximate the shoulders, said neck being circular and including an exterior annular boss; and a sample product container mounted upon the neck and shoulders of the bottle, including:

a one piece integrally formed bowl having a contoured bottom wall conforming to the shoulders and in confronting relationship therewith;

a first outer continuous sidewall integrally formed together therewith at one end defining a bottom rim;

an open end;

a first outer outwardly laterally extending peripheral flange integrally formed with a first outer sidewall end;

a centered aperture including engagement means for removably securing the bowl to the bottle neck;

a second interior minor annular sidewall surrounding the periphery of the aperture defining a product reservoir; and means for engaging the bottle handle to prevent rotational movement around the neck, relative to the handle, a quantity of sample material disposed within the product reservoir, and removable closure means for sealing the open end.

2. The article of claim 1 wherein the means for engaging the bottle handle includes an inverted shallow well "V" notch extending through the outer sidewall and the bottom wall, said notch engaging the bottle handle, and wherein the outer sidewall has gradually rounded corner portions.

3. The article of claim 2 wherein the first sidewall has a plurality of arcuate portions and a plurality of straight portions, and wherein the bottom wall is frusto-conical in shape.

4. The article of claim 3 wherein the engagement means comprises a second interiorly extending inner flange surrounding the periphery of the aperture.

5. The article of claim 4 wherein the first and second flanges are coplanar, wherein the outer sidewall is vertically aligned, wherein the interior sidewall is vertically aligned.

6. The article of claim 4 wherein the outer sidewall includes first, second and third spaced arcuate portions and two intermediate linear portions.

7. The article of claim 6 wherein the bowl is in the form of an irregular octagon and wherein the outer sidewall further includes a third linear portion spaced opposite to a middle arcuate wall portion, and an opposed pair of minor linear portions intermediate the third linear portion and the first and third arcuate portions.

8. The article of claim 5 wherein the surrounding laterally extending flange has a polygonal contour, wherein the bottom rim is generally rounded.

9. The article of claim 8 wherein the bowl is fabricated from a clear or semi-transparent material, and wherein the first, outer peripheral flange has rounded corners.

10. The article of claim 9, additionally comprising:

a sealing layer extending over the open end and removably sealed at its outer edge against the upper surface of the first outer flange and at an inner edge against the second inner flange, and a quantity of sample material disposed within the product reservoir.

11. The article of claim 10 wherein the quantity of sample material disposed within the product reservoir is a food product.

12. The article of claim 11 wherein the food product is a Ready-To-Eat cereal.

* * * * *